US009611996B2

(12) United States Patent
Brendle

(10) Patent No.: US 9,611,996 B2
(45) Date of Patent: Apr. 4, 2017

(54) MOTOR VEHICLE HEADLAMP

(71) Applicant: Automotive Lighting Reutlingen GmbH, Reutlingen (DE)

(72) Inventor: Matthias Brendle, Tuebingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 256 days.

(21) Appl. No.: 14/629,797

(22) Filed: Feb. 24, 2015

(65) Prior Publication Data

US 2015/0241009 A1 Aug. 27, 2015

(30) Foreign Application Priority Data

Feb. 25, 2014 (DE) ..... 10 2014 203 335

(51) Int. Cl.
*F21S 8/10* (2006.01)
*F21W 101/10* (2006.01)
*F21Y 101/00* (2016.01)

(52) U.S. Cl.
CPC ..... *F21S 48/1216* (2013.01); *F21S 48/115* (2013.01); *F21S 48/1154* (2013.01); (Continued)

(58) Field of Classification Search
CPC .. F21S 48/115; F21S 48/1216; F21S 48/1154; F21S 8/10; F21S 48/13; F21S 48/1323
See application file for complete search history.

(56) References Cited

U.S. PATENT DOCUMENTS

2007/0236950 A1 10/2007 Stefanov et al.
2012/0275173 A1 11/2012 Hamm et al.
(Continued)

FOREIGN PATENT DOCUMENTS

DE 202007018181 U1 6/2008
DE 102011077636 A1 11/2011
(Continued)

OTHER PUBLICATIONS

Oct. 20, 2014 German Examination Report for German Patent Application No. 10 2014 203 335.7.
(Continued)

*Primary Examiner* — Karabi Guharay
(74) *Attorney, Agent, or Firm* — Howard & Howard Attorneys PLLC

(57) ABSTRACT

A motor vehicle headlamp includes numerous semiconductor light sources disposed in a matrix, which can be activated individually for emitting light, numerous primary lenses disposed in a matrix, allocated to the semiconductor light sources, for bundling the light emitted by the semiconductor light sources and for generating a primary light distribution on light exit surfaces of the primary lenses, and a shared secondary lens for projecting the primary light distributions as secondary light distributions onto a roadway in front of the motor vehicle, such that the secondary light distributions illuminate a high-beam region. To reduce the structural height of the secondary lens without losses in terms of efficiency, the motor vehicle headlamp includes a cylindrical lens having a cylinder axis disposed in the beam path of the light module between the primary lenses and the secondary lens that is oriented such that it is substantially horizontal.

16 Claims, 6 Drawing Sheets

(52) U.S. Cl.
CPC ..... *F21S 48/1159* (2013.01); *F21S 48/1266* (2013.01); *F21S 48/1358* (2013.01); *F21S 48/1388* (2013.01); *F21S 48/1747* (2013.01); *F21S 48/328* (2013.01); *F21W 2101/10* (2013.01); *F21Y 2101/00* (2013.01)

(56) References Cited

U.S. PATENT DOCUMENTS

| | | | | |
|---|---|---|---|---|
| 2014/0204602 | A1* | 7/2014 | Jungwirth | F21S 48/1154 362/521 |
| 2014/0307459 | A1* | 10/2014 | Brendle | F21S 48/1159 362/520 |

FOREIGN PATENT DOCUMENTS

| | | | |
|---|---|---|---|
| DE | 102012008833 | A1 | 11/2012 |
| DE | 102012223658 | A1 | 6/2014 |
| EP | 1818599 | A2 | 8/2007 |
| EP | 2280215 | A2 | 2/2011 |
| EP | 2682671 | A2 | 1/2014 |

OTHER PUBLICATIONS

Nov. 6, 2015 Official Report for European Patent Application No. 15150804.1-1756.

* cited by examiner

MOTOR VEHICLE HEADLAMP

CROSS-REFERENCE TO RELATED APPLICATION

This application is based upon and claims priority to German Patent Application No. 102014203335.7, filed on Feb. 25, 2014.

BACKGROUND OF THE INVENTION

1. Field of the Invention

The present invention relates, generally, to vehicle lighting and, more specifically, to a headlamp for a motor vehicle.

2. Description of the Related Art

Conventional light modules and motor vehicle headlamps are known, for example, from DE 10 2012 223 658. The light module described therein has numerous semiconductor light sources, disposed adjacent to one another, for emitting light. A semiconductor light source is designed, for example, as a light emitting diode (e.g. LED chip) having a light emitting surface that is substantially square or rectangular. A primary lens designed as a collecting lens is allocated to each of the semiconductor light sources, which bundles the light emitted from the semiconductor light source allocated thereto. Numerous collecting lenses are disposed adjacent to one another, corresponding to the configuration of the semiconductor light sources, and combined to form a primary lens array. The collecting lenses include, by way of example, a solid transparent material, e.g. glass or plastic. They each have a light entry surface facing the semiconductor light source allocated thereto, and a light exit surface facing away from the semiconductor light source. A bundling of the light emitted from the semiconductor light source occurs by refraction at the light entry surface and/or the light exit surface and/or by total internal reflection at outer border surfaces of the collecting lens. Each collecting lens generates a substantially square or rectangular primary light distribution on its light exit surface thereby, corresponding to the shape of the light emitting surface of the light emitting diode allocated thereto.

The known light module also includes a shared secondary lens designed as a projection lens, for all of the primary lenses. The projection lens is focused on the light exit surfaces of the primary lenses, such that it projects the primary light distributions on the roadway in front of the motor vehicle as corresponding secondary light distributions. The entirety of all of the secondary light distributions corresponds to the resulting overall light distribution generated by the light module, which, for example, is a high-beam light distribution. The projection lens projects the primary light distributions as stripe-shaped secondary light distributions with a significantly greater vertical extension than the horizontal extension. It is conceivable that the individual stripe-shaped secondary light distributions are bordered laterally by sharp vertical light/dark borders. The secondary lens can also be designed as a multi-part lens, such as a double-lens achromatic lens.

A so-called non-blinding high-beam, or a partial high-beam, can be generated with the known light module. Regions are removed from the resulting high-beam light distribution by deactivating individual semiconductor light sources, those regions being where other traffic has been detected. The deactivation of the individual semiconductor light source(s) occurs thereby, dependent on a signal from one or more detectors, which are provided in the motor vehicle for the detection of other traffic in front of the motor vehicle. The detector can include at least one camera, at least one ultrasound sensor and/or at least one radar sensor.

The secondary lens can be designed such that the secondary light distributions projected onto the roadway in front of the motor vehicle border one another directly, without an overlapping of the secondary light distributions. When one of the semiconductor light sources is deactivated, the region in which there is no corresponding secondary light distribution in the resulting light distribution of the light module is bordered by relatively sharp vertical light/dark borders of the illuminated secondary light distribution of the activated adjacent semiconductor light sources. The large gradient in the illumination can be subjectively experienced by a driver of the motor vehicle as having a disruptive effect.

Alternatively, in DE 10 2012 223 658 it is described that the secondary lens is designed such that the secondary light distributions projected therefrom onto the roadway in front of the motor vehicle are disposed adjacent to one another, wherein at least the lateral regions of adjacent secondary light distributions overlap one another. This can be obtained in that a fundamental shape of a light exit surface on the projection lens is modulated such that a single primary light distribution is converted to a plurality of corresponding sub-regions of the corresponding secondary light distribution, wherein the sub-regions are of equal size, and are displaced with the same orientation in the horizontal direction in relation to one another, and disposed such that they overlap one another. The entirety of all sub-regions arising from a specific primary light distribution forms the corresponding secondary light distribution. Therefore, sharp vertical light/dark borders, which border the stripe-shaped secondary light distributions, and thus the large gradients in the illumination formed when a semiconductor light source is deactivated, are avoided.

Collecting lens arrays are best suited for use as primary lenses, because they make limited demands on raw materials, mold precisions and positioning precisions. When collecting lens arrays are used, comparatively small secondary lenses are sufficient. As a result, the aberrations in the secondary lens can also be kept small. The prerequisite for this, however, is a relatively large aperture (the relationship of the focal length to the diameter of the effective entry surface of the secondary lens). With lens systems, the aberrations are primarily color errors, whereas with reflection systems with small apertures, these are primarily comatic aberrations.

One disadvantage of the primary lenses designed as a collecting lens array is that an aperture angle of the emitted light bundle in relation to an optical axis of the secondary lens is basically the same size in all directions, and thus can only be varied to a small degree. Expressed differently, this means that an enlargement of the light emitting surface of the semiconductor light sources with a lens disposed directly in front of the light source is of a similar size, both horizontally as well as vertically. An anamorphic enlargement of the primary light distributions can only be obtained within very narrow limits. Because the vertical expansion of stripe-shaped matrix light distributions is a multiple of the width thereof, however, it would be desirable for the enlargement of the light emitting surfaces of the semiconductor light sources to be adjusted to the stripe-shaped secondary light distributions, thus to increase the size of the illuminated surfaces on the light exit surfaces of the primary lens more in the vertical direction than in the horizontal.

As set forth in the Helmholtz-Lagrange invariant, one can significantly reduce the angle of emission for the primary lens in the vertical cross-section with this measure, by which the vertical expansion, i.e. the height, of the secondary lens, can be reduced in the opposite manner:

$$y \times n \times \sigma = y' \times n' \times \sigma'$$

Where y, and y' are the object or image size; σ, and σ' are the object or image-side aperture angle; and n, and n' are the object or image-side refraction index.

Furthermore, with the known matrix high-beam light modules, due to the large focal lengths of the secondary lenses, there are problems with the structural lengths of the light modules. The long focal lengths arise thereby due to the required width/spacing of the generated matrix light distributions, on one hand, and the spacing of the semiconductor light sources/primary lens on the other hand. The width of the light distributions is largely dependent on the desired resolution and performance of the light module, while the spacing of the primary lenses is primarily dependent on the required minimum spacing and component sizes of the semiconductor light sources.

For this reason, it has already been considered in the prior art to bend the beam path by a deflecting mirror or a deflecting prism, thus reducing the critical structural lengths of the light module. Deflection mirrors or prisms cause, however, additional losses of luminous flux in the beam path.

SUMMARY OF THE INVENTION

The present invention overcomes the disadvantages in the related art in creating a light module for generating at least two stripe-shaped secondary light distributions, immediately adjacent to one another in at least one line, or overlapping, with which the at least two adjacent secondary light distributions are formed by numerous semiconductor light sources or light source groups, and with which the structural height of the secondary lens can be reduced without substantial losses in luminous flux. Furthermore, the light module should have a shorter structural length with respect to known light modules, while still exhibiting comparable performance characteristics (e.g. resolution, maximum luminosity, etc.)

The light module includes numerous semiconductor light sources for emitting light, disposed in a matrix, adjacent to and/or above one another, which can be activated individually. The light module also includes numerous primary lenses allocated to the semiconductor light sources, disposed in a matrix, adjacent to and/or above one another, for bundling at least a portion of the light emitted from the semiconductor light sources, and for generating a primary light distribution on light exit surfaces of the primary lenses. The light module also includes a shared secondary lens for projecting the primary light distributions as secondary light distributions on a roadway in front of the motor vehicle such that the secondary light distributions illuminate a high-beam region.

It is proposed that a cylindrical lens be disposed in the beam path of the light module, between the primary lenses and the secondary lens, which has, substantially, no refraction in the horizontal cross-section, and has light collecting characteristics in the vertical cross-section.

A cylindrical lens as set forth in the present invention is understood to mean a lens that has no, or very little, refraction in the horizontal cross-section, in which, thus, the horizontal cross-section curves are at least nearly straight, which acts as a collecting lens in the vertical cross-sections, thus having a collecting lens profile or a concave mirror profile. The vertical cross-section curves need not necessarily be circular. Furthermore, the center of curvature in the vertical cross-section does not have to lie in a cylinder axis.

The cylindrical lens can significantly reduce the aperture angle of the light bundle from the primary lenses in the vertical cross-section, such that the structural height of the secondary lens can be reduced in a corresponding scale. The secondary lens focuses onto the light exit surfaces of the primary lens array via the cylindrical lens. The cylindrical lens causes an anamorphic enlargement of the primary light distributions onto the light exit surfaces of the primary lenses, such that secondary light distributions (so-called pixels) are obtained, the heights of which can be a multiple of the respective pixel widths. As a result, the height of the secondary lens can be reduced in basically the same scale in relation to conventional light module and headlamp designs, which frequently require particularly flat and wide lenses and/or reflectors as the secondary lenses. This is caused by, among other things, the increasingly aerodynamic shapes of the fronts of vehicles, for achieving greater fuel efficiency and lower airflow noises.

The inventive light module can be created with secondary lenses that are two to five times as short, with practically no compromise to the optical efficacy. Only the reflection and/or transmission losses at the cylindrical lens need to be taken additionally into account when calculating the efficacy. These losses are, however, significantly lower than the losses with known light modules, in which deflection mirrors or prisms are disposed in the beam path.

The cylindrical lens can have circular cross-section curves in a vertical cross-section, and the centers of curvature in the vertical cross-section coincide in a cylinder axis. This describes the special case of a "real" cylindrical lens, or a "real" cylindrical reflector, having a constant curvature over the entire surface, and a common cylinder axis.

If a cylindrical concave mirror is used as the cylindrical lens, it is then also possible to bend the beam path with this mirror, for example in that the optical axis is bent in a horizontal and/or vertical plane. In this way, the structural length of the lens can be significantly reduced. A cylindrical lens designed as a cylindrical reflector can, at least in sections, exhibit a parabolic profile.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 8:
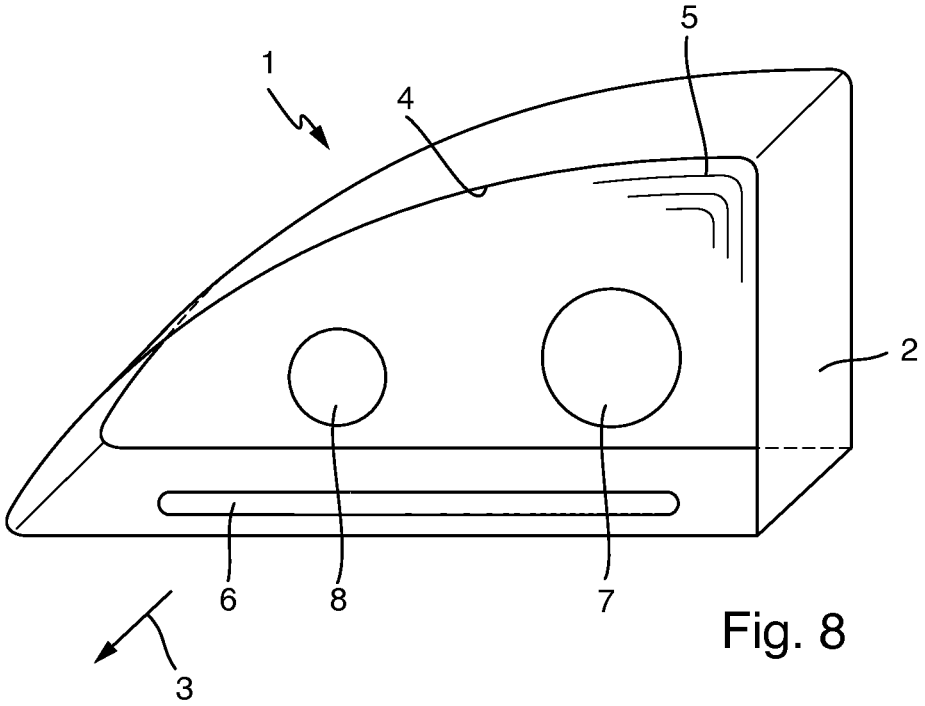
FIG. 8 shows an inventive headlamp for a motor vehicle as set forth in an embodiment.

With reference now to the drawings, FIG. 8 shows an example for an inventive motor vehicle headlamp, indicated in its entirety by the numeral 1. The headlamp 1 includes a housing 2, which in one embodiment is made of a plastic material. A light exit aperture 4 provided in the housing 2 in the direction of the light emission 3 is closed by a transparent cover plate 5. The cover plate 5 is made, for example, of glass or plastic. The cover plate 5 can be designed such that it has no optically effective profile (e.g. prisms or cylindrical lenses) (so-called clear plates), or can be provided, at least in sections, with optically effective profiles, which can cause a diffusion of the light passing through it, in particular in the horizontal direction (so-called diffusion lenses). A lamp module can be disposed in the interior of the headlamp 1, which serves for the implementation of a lamp function (e.g. blinker lights, daytime running lights, positioning or parking lights, etc.).

Furthermore, as shown in FIG. 8, an inventive light module 7 is disposed in the interior of the housing 2, which is designed for implementing a high-beam light distribution by an overlapping of numerous stripe-shaped secondary light distributions, each having a substantially vertical longitudinal extension (in the following also referred to as a striped high-beam). Through targeted dimming or switching off of individual stripe-shaped secondary light distributions, regions of the high-beam light distribution in which other traffic has been detected can be turned off, in order to avoid blinding them (so-called non-blinding high-beams or partial high-beams). The high-beam generated by the light module 7 can include numerous light distributions that can be generated by the light module 7. It is likewise conceivable that the high-beam light distribution generated by the light module 7 is only a portion of a light distribution that fulfills the requirements of government-mandated regulations, wherein another portion of the light distribution that fulfills such requirements can be generated by at least one other light module of the headlamp 1, e.g. the light module 8. Thus, it would be conceivable, for example, that the light distribution generated by the light module 7 is a high-beam spot, while the light module 8 generates a high-beam fundamental distribution. An overlapping of the two high-beam partial light distributions (spot and fundamental light) generates a high-beam that fulfills the requirements and/or provides a particularly efficient illumination of the roadway in front of the vehicle. As a matter of course, it is also conceivable that the light distribution generated by the light module 7 already fulfills the legal requirements for a high-beam, but a subjectively and/or objectively better illumination can be implemented with high-beams, however, by the overlapping thereof with the partial light distribution generated by the light module 8.

Figure 1B:
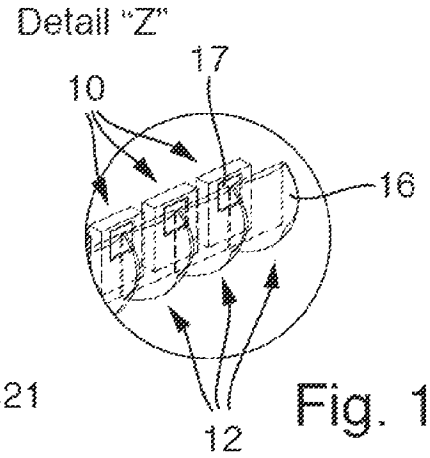
FIG. 1B shows a detail Z of the semiconductor light sources and the primary lenses of the light module from FIG. 1A.
Figure 1A:
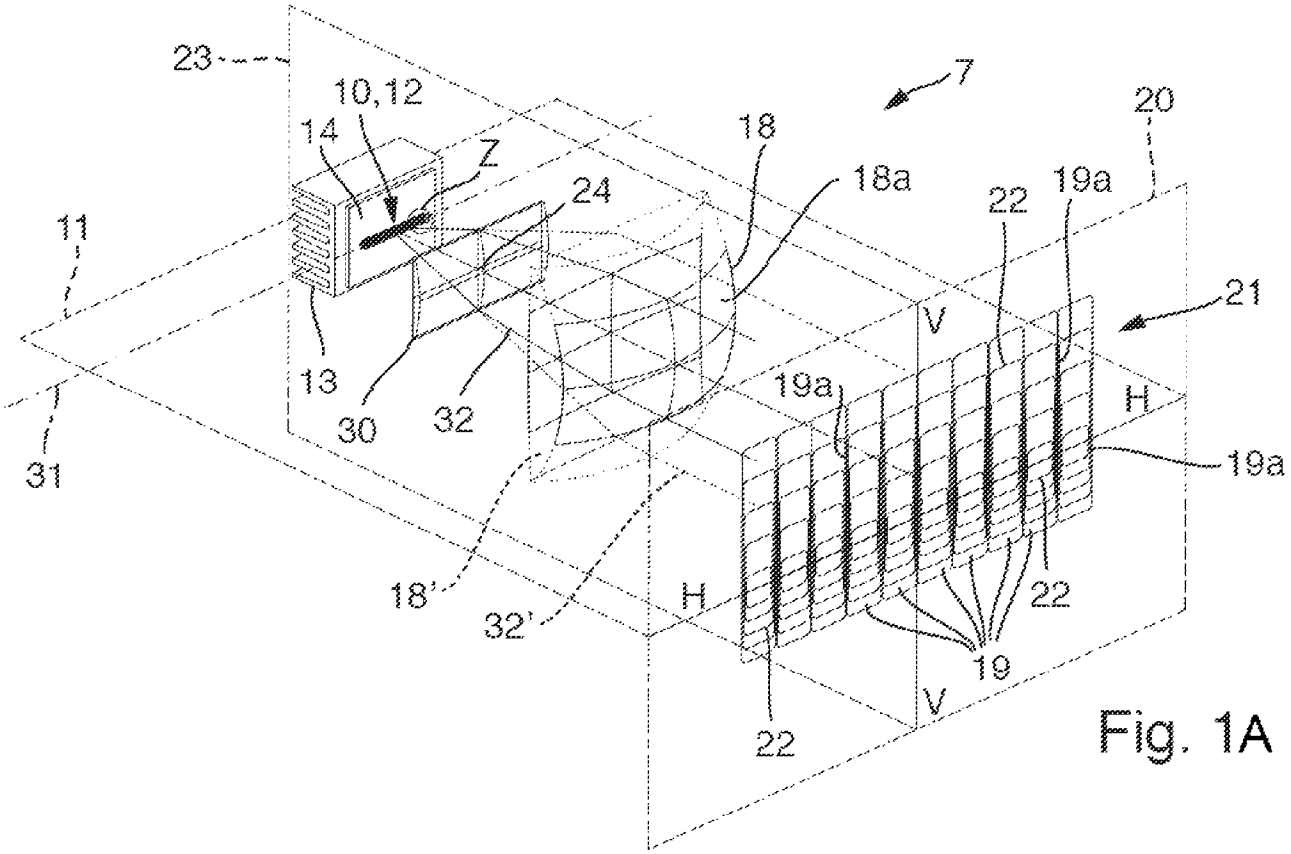
FIG. 1A shows an inventive light module as set forth in a first embodiment.

Referring now to FIG. 1A, a first example of an inventive light module 7 is shown. The light module 7 includes numerous semiconductor light sources 10 that can be activated individually, disposed in a matrix, adjacent to one another, in a horizontal central plane 11 or parallel thereto (cf. FIG. 1B), for emitting light. The light sources 10 are designed, e.g. as light emitting diodes (LEDs or LED-chips). "In a matrix" as set forth in the present invention means that numerous LEDs 10 can be disposed both adjacent to one another, in a single row, as well as, in an alternative embodiment, adjacent to and above one another, in numerous rows. The light sources 10 are advantageously attached to a cooling element 13 (directly or indirectly, by a printed circuit board 14), such that heat occurring during the operation of the light sources 10 can be discharged and conveyed into the environment.

Figure 7A:
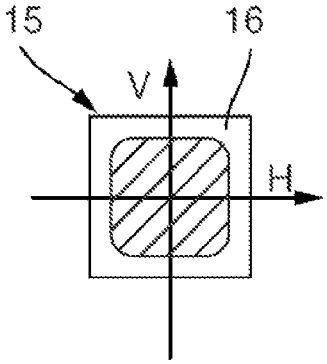
FIG. 7A shows a primary light distribution as an illuminated light exit surface of a primary lens of an inventive light module.

Furthermore, the light module 7 includes numerous primary lenses 12 allocated to the semiconductor light sources 10 and likewise disposed adjacent to one another in a matrix, for bundling at least a portion of the light emitted from the semiconductor light sources 10, and for generating a primary light distribution 15 (as shown in FIG. 7A), in each case on light exit surfaces 16 of the primary lenses 12.

The primary lenses 12 are advantageously designed as collecting lenses, such that the entirety of the primary lenses 12 forms a collecting lens array. The primary light distributions 15 correspond to a uniform illumination of the light exit surfaces 16 by the light, in each case, from one of the light emitting surfaces 17 of a light source 10.

Figure 6:
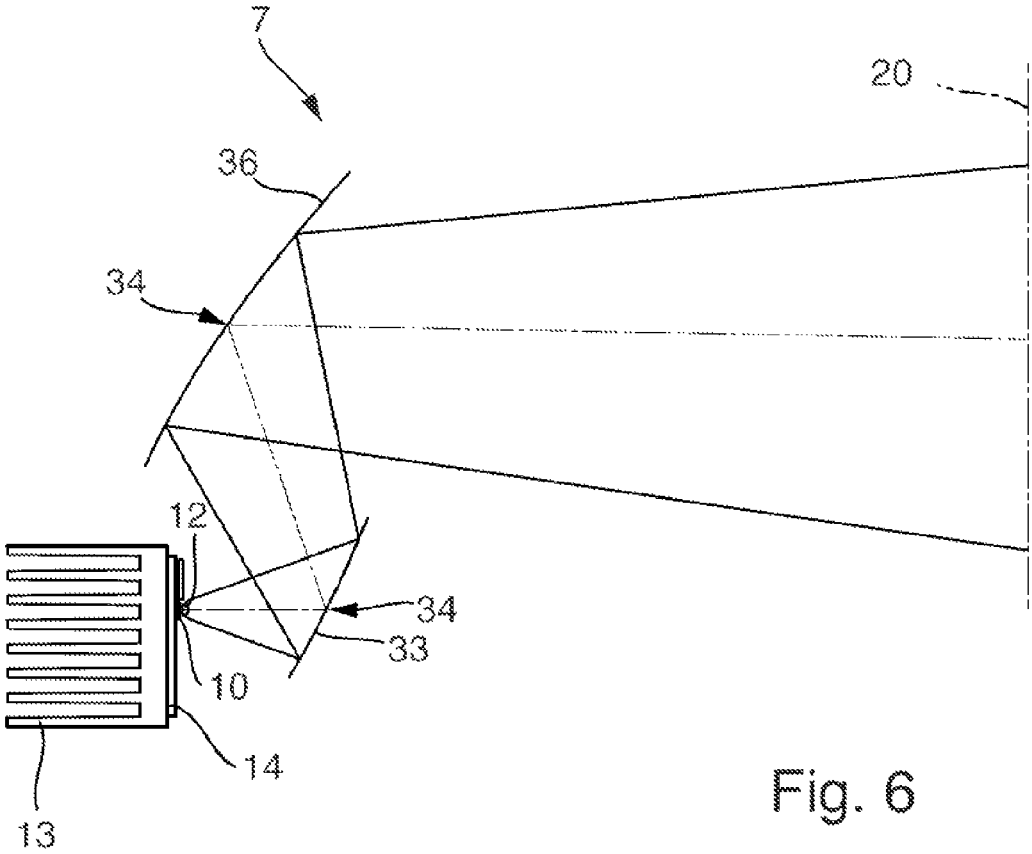
FIG. 6 shows a vertical cross-section cut through a light module as set forth in a fourth embodiment.

Moreover, the light module 7 includes a shared secondary lens, which can be designed as a projection lens 18 as shown in the depicted embodiment in FIG. 1A, or alternatively, as a parabolic reflector 36 as shown in the depicted embodiment in FIG. 6. The secondary lens (projection lens 18 or reflector 36) projects the primary light distributions 15, which are depicted on the light exit surfaces 16 of the primary lenses 12, as stripe-shaped secondary light distributions 19 on a roadway in front of the motor vehicle. The secondary light distributions 19 collectively result in an illuminated high-beam region. The light module 7 thus serves to generate a high-beam light distribution 21.

In the embodiment depicted in FIG. 1A, the secondary light distributions 19 are not projected onto a roadway, but instead, onto a vertical measurement screen 20, disposed at a spacing from the light module 7. Through the use of numerous light sources 10, disposed only in a row, adjacent to one another, and correspondingly disposed primary lenses 12, each of the secondary light distributions 19 together form the entire depicted vertical extension. As shown, the resulting high-beam light distribution 21 is composed of a plurality of vertical, stripe-shaped (having substantially vertical longitudinal extensions) secondary light distributions 19 disposed adjacent to one another. In the depicted example, ten secondary light distributions 19 are disposed adjacent to one another. The lines 22 depicted inside the secondary light distributions 19 are regions having the same luminosity (so-called isolux curves). The secondary light distributions 19 advantageously have their greatest luminosity values, in each case, in the region of the horizontal plane 11. The luminosity values within a stripe-shaped secondary light distribution 19 decrease above and below this plane.

A horizontal line HH is drawn on the measurement screen 20, which corresponds to an intersecting line of the horizontal plane 11 with the measurement screen 20. Additionally, a vertical line VV is drawn on the measurement screen 20 that corresponds to an intersecting line of a vertical central plane 23 with the measurement screen 20. An intersecting line of the horizontal plane 11 and the vertical plane 23 corresponds to an optical axis 24 of the projection lens 18, or in this case, an optical axis 24 of the entire light module 7. As shown, a majority of the resulting light distribution 21 lies above the horizontal line HH, i.e. a high-beam region in front of the motor vehicle is illuminated.

Each secondary light distribution 19 is generated by the light from one of the semiconductor light sources 10, after it has been bundled by the corresponding primary lens 12 and has been projected by the projection lens 18 onto the measurement screen 20. Through a targeted switching off of the individual light sources 10, individual secondary light distributions 19 can be removed in a targeted way from the resulting high-beam light distribution 21. By way of example, those light sources 10, in the corresponding secondary light distributions 19 of which another road user (e.g. a car in front of the vehicle, or oncoming traffic) has been detected, can be deactivated. In this way, an optimal illumination of the roadway region in front of the vehicle can be obtained (normally with high-beams), and at the same time, it can be ensured that the detected other traffic will not be blinded.

The secondary lens, which in the embodiment shown in FIG. 1A is the projection lens 18, can be designed such that the secondary light distributions 19 projected therefrom onto the roadway (or measurement screen) in front of the motor vehicle border one another directly, without overlapping. When one of the semiconductor light sources 10 is deactivated, the region in which there is no corresponding secondary light distribution 19 in the resulting light distribution 21 of the light module is bordered by relatively sharp vertical light/dark borders 19*a* of the illuminated secondary light distributions 19 of the activated adjacent semiconductor light sources 10. This large gradient in the luminosity may be subjectively experienced by a driver of the vehicle as having a disturbing effect. Moreover, the secondary lens can be designed such that the secondary light distributions 19 projected therefrom onto the roadway (or the measurement screen 20) in front of the motor vehicle are disposed adjacent to one another, wherein at least the lateral regions of adjacent secondary light distributions 19 overlap one another. This can be obtained in that a fundamental shape of a light exit surface 18*a* of the projection lens 18 is modulated such that a single primary light distribution 15 on a light exit surface 16 of a primary lens 12 is converted to a plurality of corresponding sub-regions of the corresponding secondary light distribution 19. The sub-regions are advantageously of uniform size, and displaced with the same orientation in the horizontal direction relative to one another, and disposed such that they overlap one another. The entirety of all of the sub-regions resulting from a specific primary light distribution 15 forms the corresponding secondary light distribution 19. In this way, sharp vertical light/dark borders 19*a*, which border the stripe-shaped secondary light distributions 19, and thus form large gradients in the luminosity when a semiconductor light source 10 is switched off, are avoided.

Figure 2:
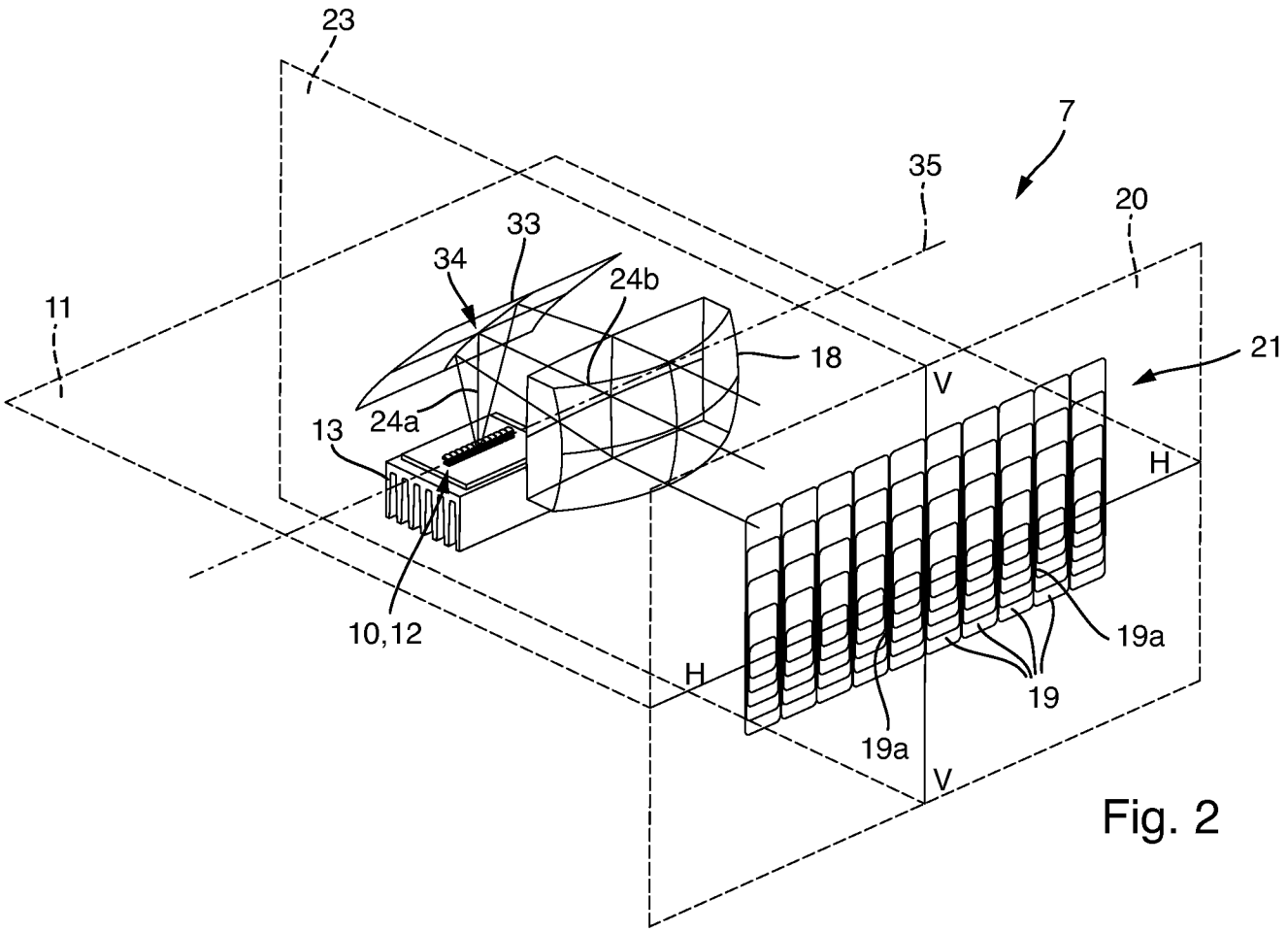
FIG. 2 shows an inventive light module as set forth in a second embodiment.
Figure 3:
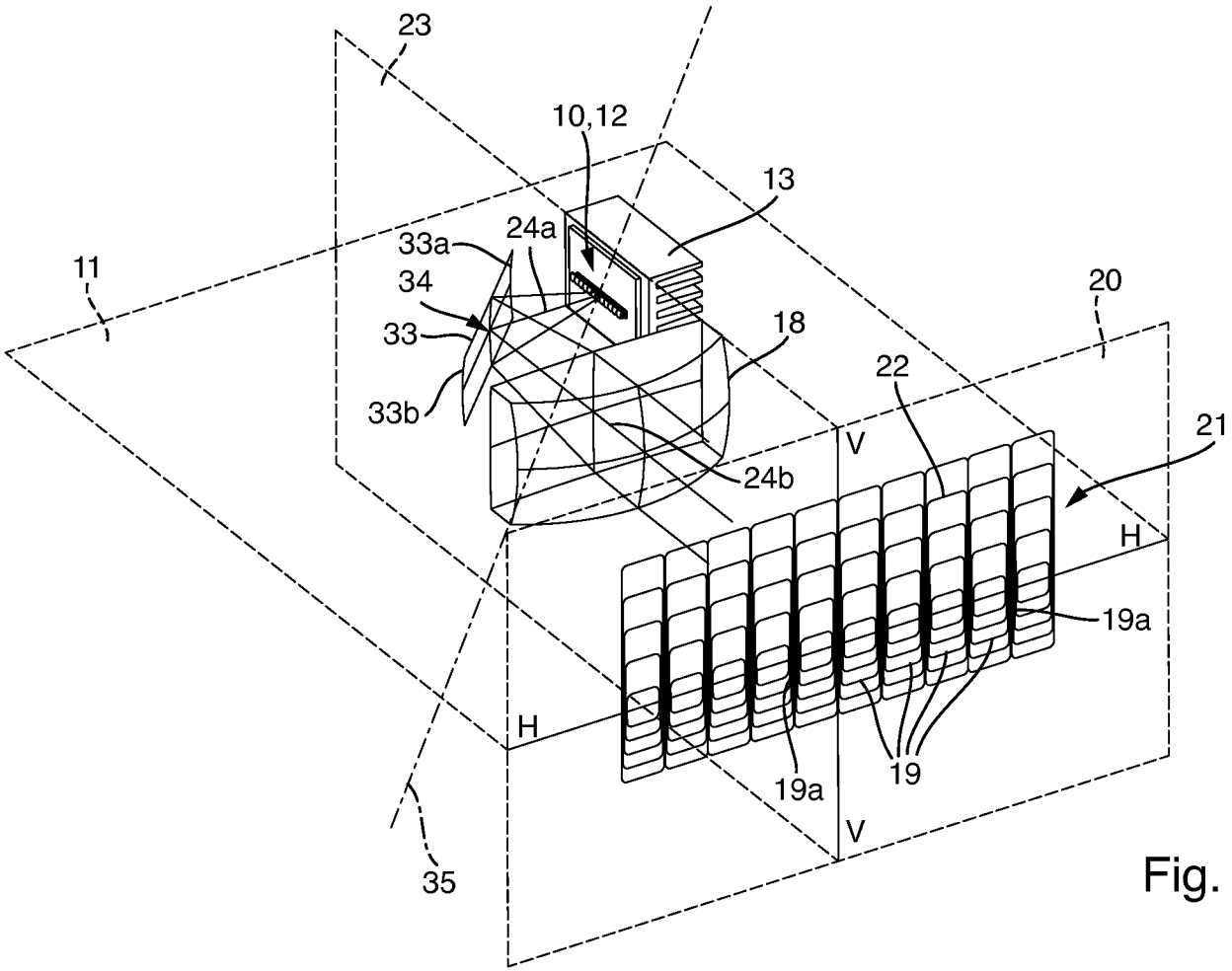
FIG. 3 shows an inventive light module as set forth in a third embodiment.
Figure 5:
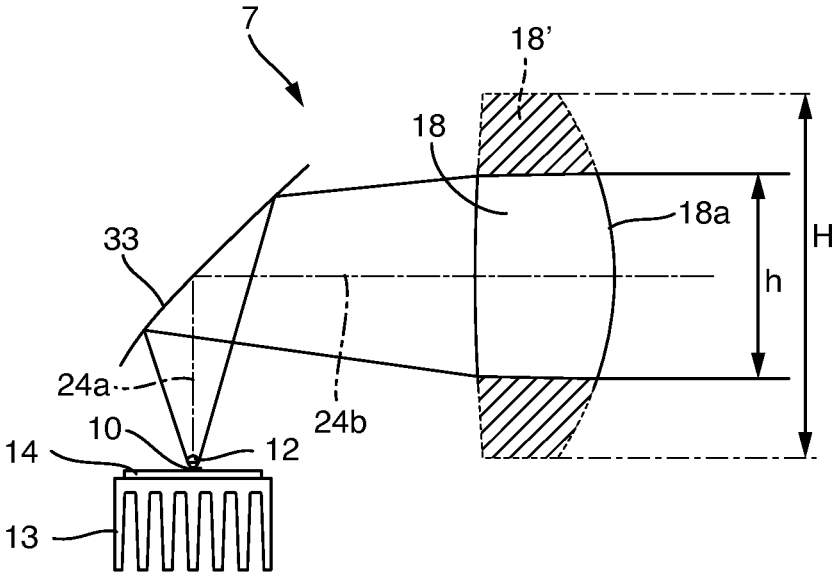
FIG. 5 shows a vertical cross-section cut through the light module from FIG. 2.

In order to reduce the height of the projection lens 18, if possible without substantial losses in luminous flux, and thus the height of the overall light module 7, the invention proposes that a cylindrical lens 30 be disposed in the beam path of the light module 7, between the primary lenses 12 and the projection lens 18. In an alternative embodiment as shown in FIGS. 2, 3, and 5, the cylindrical lens 30 may alternatively include cylindrical reflector 33. The cylindrical lens 30 as set forth in the present invention is understood to be a lens that exhibits no, or very little, refraction in the horizontal cross-section, with which, thus, the horizontal cross-section curves are at least nearly straight, and which exhibits a collecting effect in the vertical cross-section, thus having a collecting lens profile or a concave mirror profile. The vertical cross-section curves need not necessarily be circular. Moreover, the mid-point of the curvature in the vertical cross-section need not fall in a cylinder axis.

In the example from FIG. 1A, the cylindrical lens 30 is designed as a cylindrical lens 30 having a cylinder axis 31, which is substantially horizontal, i.e. runs parallel to the horizontal plane 11. The cylinder axis 31 can run on, or through, the light exit surfaces 16 of the primary lenses 12. The cylinder axis 31 extends advantageously in the horizontal plane 11 at a right angle to the optical axis 24 of the projection lens 18.

The projection lens 18 forms, together with the cylindrical lens 30, and optics system, which is focused on the light exit surfaces 16 of the primary lenses 12. The cylindrical lens 30 reduces the beam angle of the primary lenses 12 in the vertical direction. As a result, the height of the projection lens 18 can be significantly reduced. A beam path 32' without the use of the cylindrical lens 30, with the associated larger projection lens 18', is depicted in FIG. 1A by a broken line. A beam path 32 of the inventive light module 7 with the cylindrical lens 30 is illustrated with a continuous line. As shown, the necessary structural height of the projection lens 18 in the present invention is significantly lower than with the projection lens 18'.

The cylindrical lens 30 exhibits no, or very little, refraction in all horizontal cross-sections (perpendicular to the vertical light/dark borders 19*a* of the secondary light distributions 19, or the stripe-matrix, respectively). In these cross-sections the cylindrical lens 30 exhibits the same wall thicknesses. In the vertical cross-sections, conversely, the refraction of the cylindrical lens 30 is maximal. The cylindrical lens 30 exhibits the greatest differences here in the wall thickness between the center of the lens and the edge thereof.

The cylindrical lens (cylindrical lens 30 or cylindrical reflector 33) advantageously generates the entire vertical course of the light distribution 21. The secondary lens (projection lens 18 or reflector 36) advantageously exhibits no refraction thereby in the vertical cross-sections, i.e. the secondary lens 18 is likewise designed as a cylindrical lens. This pertains to the special case of two crossed cylindrical lenses, the focal lines of which cross in the middle of the light exit surfaces 16 of the primary lenses 12. The cylindrical lens (cylindrical lens 30 or cylindrical reflector 33) advantageously fulfills the sine conditions, wherein equal projection scales prevail in all lens zones. A vertical focal line of the cylindrical lens (cylindrical lens 30 or cylindrical reflector 33) lies as close as possible to the center of the light exit surface 16 of the primary lenses 12.

Moreover it is conceivable that a cylindrical fundamental shape of the cylindrical lens 30 is superimposed with a modulation on its light exit surface, which provides the lens with sharply focused projection characteristics. This modulation is functionally defined such that the cylindrical lens 30 has at least one optical surface, which modulates the fundamental shape such that the cylindrical lens 30 converts a single light distribution of the primary light distribution 15 into a plurality of second sub-regions of a projection 38 of the primary light distribution 15, which are of a uniform size, and are displaced in relation to one another with the same orientation, and disposed such that they overlap. In terms of the structure, the modulation in the described design of the cylindrical lens 30 is generated by a first wave-shaped deformation of the optical surface, which is superimposed on the fundamental shape, and which includes at least one concave and one convex half-wave. The wave-shaped deformation exhibits a partially cylindrical shape, the cylinder axis of which is oriented parallel to the light/dark border of the light distribution. The wave-shaped deformation of the light exit surface of the cylindrical lens 30 is a component of the last optical surface in a beam path in which the primary light distribution 15 transitions into the projection 38.

Figure 9:
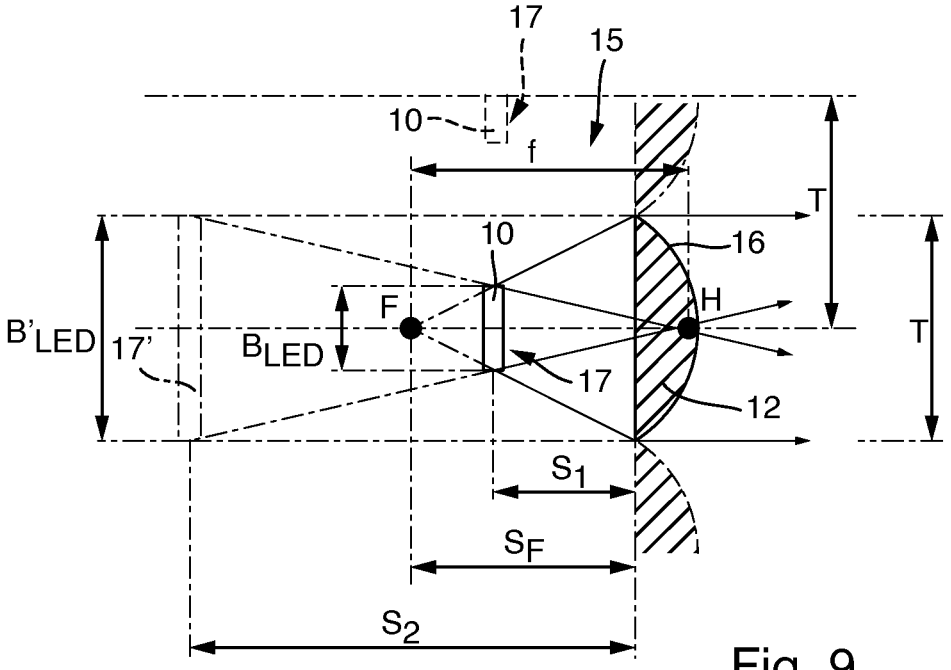
FIG. 9 shows a substitute light source assembly in an embodiment, as it can be used in the inventive light module.

FIG. 9 shows, by way of example, a section of a substitute light source assembly for use in an inventive light module 7. One of numerous semiconductor light sources 10 in the form of an LED chip 17 is depicted. One of numerous collecting lenses 12 of a collecting lens array is depicted, by way of example, downstream of the LED chip 17 in the light exit direction. A division of the lens array is indicated with a T. The division T corresponds to the width of the individual collecting lens 12, as well as the spacing of the center points of adjacent LED chips 17. $B_{LED}$ indicates an edge length of the LED chip 17. A virtual LED chip is indicated by 17'. The edge length of the virtual LED chip 17' is indicated by $B'_{LED}$. An object-side focal point of the collecting lens 12 is indicated by F, and a main point of the lens 12 is indicated by H. The main point H of a lens is defined as the intersecting point of a main plane of the lens with the optical axis of the lens. The secondary lens (projection lens 18 or reflector 36) of the inventive light module 7 is advantageously focused onto a main point H of one of the collecting lenses, and advantageously onto the main point H of the collecting lens 12 located in the proximity of an optical axis 24 of the light module 7. When the light module 7 has a bent optical axis (cf., e.g., FIGS. 2, 3, 5, 6), the secondary lens (projection lens 18 or reflector 36) of the inventive light module 7 is advantageously focused onto a main point H of the collecting lens 12 located in the proximity of an optical sub-axis 24*b* of the secondary lens (projection lens 18 or reflector 36). The reference symbol f indicates the focal length of the lens 12 and $S_F$ indicates a back focal length of the lens 12. A spacing between the LED chip 17 and the light entry surface of the collecting lens 12 is indicated by $S_1$, and a spacing between the virtual chip image 17' and the light entry surface of the lens 12 is indicated by $S_2$.

The LED chip 17 lies between the primary lens, designed in this example as the lens 12, and its object-side focal point F. The LED chip 17 is enlarged by the lens 12 such that the (upright) virtual image 17' of the chip 17 (in the light exit direction, in front of the object-side lens focal point F) is basically the same size as the lens 12, i.e. $B'_{LED} \approx T$. For the given variables, the following approximation equation applies:

$$\frac{S_F - S_1}{S_F} \approx \frac{B_{LED}}{T} \approx \frac{B_{LED}}{B'_{LED}}$$

In one embodiment, 0.1 mm≤S1≤2 mm; and $1 \times B_{LED} \leq T \leq 4 \times B_{LED}$.

The collecting lenses 12 of the lens array serve not only to generate real intermediate images of the light sources 10, or the light emitting surface 17, but they also form only one illuminated surface (the primary light distribution 15) on the light exit surface 16 of the collecting lenses 12. The light sources 10 are disposed between the light entry surfaces of the lenses 12 and the object-side focal points F of the lenses 12, such that the edges of LED chip surfaces 17 lie on geometrical connections of the focal points F to the lens edges. The emission surfaces 17 of the light sources 10 are disposed perpendicular to the optical axes of the lenses 12. As a result, a very uniform illumination of the lenses 12 is obtained, and a particularly homogenous light distribution, the so-called intermediate light distribution, or primary light distribution 15, is obtained on the light exit surfaces 16 of the lenses 12. These primary light distributions 15 are projected by the secondary lens (projection lens 18 or reflector 36) for generating the resulting overall light distribution 21 of the light module 7 onto the roadway in front of the vehicle. The optical axes of the individual lenses 12 of the lens array all run in a single plane, advantageously parallel to one another. When the light module 7 does not have a bent optical axis 24 (cf. e.g. FIG. 1A, 4), the optical axis of the secondary lens (projection lens 18 or reflector 36) is parallel to the optical axis of at least one of the lenses 18 on the side facing the primary lenses 12.

A second embodiment example of the present invention is depicted in FIG. 2. In this case, the cylindrical lens in the beam path between the primary lenses 12 and the secondary lens, which in this case is the projection lens 18, is designed as a cylindrical reflector 33. If this has a cylinder axis 35, it is advantageously oriented such that it is substantially horizontal, i.e. it runs parallel to the horizontal plane 11. The cylinder axis 35 can run on, or through, the light exit surfaces 16 of the primary lenses 12. The reflector 33 bends the beam path (bent beam path 34) at the vertical central plane 23. As a result of the bending of the beam path, the structural length of the light module 7 can be significantly shortened. The beam path is thus bent by the cylindrical reflector 33, i.e. the optical axis 24 of the light module is bent, such that there are two sub-axes 24*a*, 24*b* that run at an angle to one another. This advantageously occurs in the vertical plane 23 (cf. FIGS. 2 and 5) or in a horizontal plane 11 (cf. FIG. 3) that contains the bent optical axis 24*a*, 24*b*. In this case, a first optical axis 24*a* is advantageously allocated to one of the primary lenses 12, and a further optical axis 24*b* is allocated to the projection lens 18. The beam path is advantageously bent at a right angle or an acute angle by the cylindrical reflector 33.

With this embodiment example as well, the cylindrical lens, cylindrical reflector 33, exhibits no, or very little, refraction in all horizontal cross-sections (perpendicular to the vertical light/dark borders 19*a* of the secondary light distributions 19, or the stripe-matrix). In these cross-sections, the curvature of a cylindrical reflector 33 is zero. In the vertical cross-sections the refraction of the cylindrical lens, in contrast, is at a maximum. The cylindrical reflector 33, or its reflection surface, respectively, display a maximum curvature in the vertical cross-sections. The cylindrical reflector 33 can have, at least in sections, a parabolic profile. A horizontal focal line of the cylindrical reflector 33 lies as close as possible to the middle of the light exit surfaces 16 of the primary lenses 12.

A further embodiment example is shown in FIG. 3, in which the beam path is bent in a horizontal plane 11 (bent beam path 34). In this case, the cylindrical lens is designed as a cylindrical reflector 33. If the cylindrical lens 33 has a cylinder axis 35, it is advantageously oriented such that it is transverse to an angle bisector of an angle spanning an optical axis 24*a* allocated to one of the primary lenses 12 and an optical axis 24*b* allocated to the secondary lens, which in this case is projection lens 18. In the horizontally bent beam path, the curvature in the vertical cross-sections of the cylindrical deflection mirror 33 is advantageously varied such that the curvature (1/radius) is greater at one of the mirror sides 33*a* facing the primary lenses 12 than at a side 33*b* facing the secondary lens 18 (cf. FIG. 3). The reflection surface of the cylindrical reflector 33 should furthermore be designed as a ruled surface, such that the curvature in the horizontal cross-sections, e.g. in the horizontal plane 11, remains zero. Thus, a cone-like surface is formed by the cylindrical surface, wherein a cone point lies on the side with the primary lenses 12. The curvature in the vertical cross-sections, however, is advantageously not uniform (i.e. a ring segment), but rather, can be varied along the profile, such that the desired vertical luminosity curve (cf. the isolux lines 22) is obtained in secondary light distribution 19.

The optics system disposed downstream of the primary lenses 12, i.e. the cylindrical lens 30; 33 and the secondary lens 18; 36 (designed in each case as either a lens or a reflector), form the vertical borders between adjacent light exit surfaces 16 of the lens array 12, in the form of vertical light/dark borders 19*a*. The vertical light/dark borders 19*a* are substantially generated by the secondary lens (projection lens 18 or reflector 36), and the cylindrical lens (cylindrical lens 30 or cylindrical reflector 33) exhibits, substantially, no refraction in the relevant horizontal cross-sections. This results in the horizontal cross-sections, running through the optics system 30; 33 and 18; 36, there are optical paths of equal length between the light exit surfaces 16 of the primary lenses 12 and the edges (i.e. vertical light/dark borders) 19*a* of the matrix light distributions 19. The light exit surface 18*a* of the projection lens 18 is furthermore provided with, advantageously, a microstructure that diffuses light at least in the horizontal plane.

A cylindrical reflector 33 as shown in the embodiments depicted in FIGS. 2, 3, 5, and 6 has advantages with respect to other deflecting mirrors placed in the beam. Firstly, the cylindrical reflector 33 does not generate a rotated projection of the light source 10, or the light emitting surface 17, or a comatic aberration, in contrast to a rotational hyperboloid. Moreover, there is no negative affect to the object field curvature, or the edge focus of the pixels 19. The light/dark borders 19*a* of the matrix light distributions 19 remain sharply focused, or remain diffused in the defined manner (if a diffusing secondary lens 18 is used). Secondly, an aperture angle of the beam bundle, leaving the primary lenses 12 toward the secondary lens 18, can be substantially reduced in the vertical cross-sections, in contrast with a flat deflection mirror, the necessary aperture of the secondary lens 18 (lens height, or reflector height, respectively) can be significantly reduced.

Thus, through the use of a cylindrical reflector 33, the structural length of the light module 7 and the structural height of the secondary lens can be significantly reduced. In this way, particularly compact, but at the same time efficient, light modules 7 and headlamps 1 for motor vehicles can be created. The invention offers advantages in most headlamp installation spaces, or, respectively, enables, for the first time, the installation of a matrix high-beam light module 7.

Figure 4:
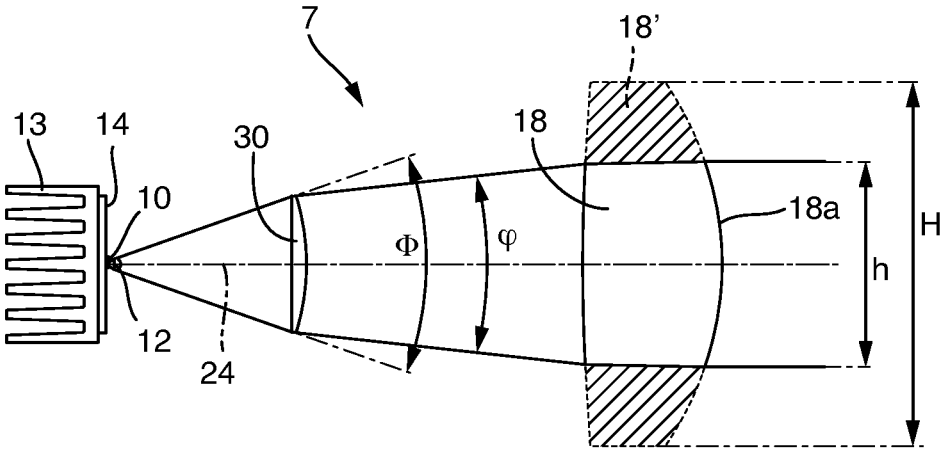
FIG. 4 shows a vertical cross-section cut through the light module from FIG. 1A.

FIG. 4 shows a vertical cross-section cut through an inventive light module 7, as is depicted, by way of example, in FIG. 1A. The light module 7 includes an LED array 10, a primary lens array 12, a cylindrical lens 30 and a projection lens 18. Because of the cylindrical lens 30, the emission angle of the primary lenses 12 is reduced from $\Phi$ to $\phi$. Thus, the height of the projection lens 18 can also be reduced from H to h. The part of the conventional projection lens 18' of the light module known from the prior art that is no longer needed for the projection lens 18 of the inventive light module 7 is shaded in. By removing the shaded region, a projection lens 18 that is flattened at the top and bottom is obtained, having a particularly short structural height.

In FIG. 5, a vertical cross-section cut through an inventive light module 7 is depicted, as it is depicted, for example, in FIG. 2. The light module 7 includes an LED array 10, a primary lens array 12, a cylindrical reflector 33, and a projection lens 18. Because of the cylindrical reflector 33, the emission angle of the primary lenses 12 is reduced and the beam path is bent. Thus, the height of the projection lens 18 can also be reduced from H to h. The part of the known projection lens 18' that is no longer needed for the projection lens 18 of the inventive light module 7 is shaded in here as well.

FIG. 6 shows another embodiment example of an inventive light module 7, which is similar to the example shown in FIG. 5, but having a reflector 36 as the secondary lens. The reflector 36 is advantageously designed as a parabolic reflector. Here as well, it is the case that the cylindrical reflector 33 reduces the emission angle of the primary lenses 12 in the vertical direction, such that the height of the secondary lens, reflector 36, can be significantly reduced with respect to conventional light modules without a cylindrical reflector 33. The reflector 36 projects the primary light distributions 34, enlarged by the cylindrical reflector 33, onto the roadway (or a measurement screen 20) in front of the motor vehicle as secondary light distributions 19. The resulting light distribution 21 of the light module 7 is obtained from an overlapping of all of the active secondary light distributions 19.

Figure 7B:
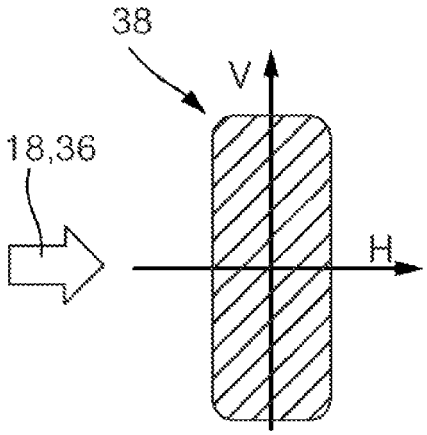
FIG. 7B shows the illuminated surface from FIG. 7A after an enlargement by a cylindrical lens of the inventive light module.

The projections of the primary lenses 12 are depicted in FIGS. 7A and 7B, each of which delineates an infinitesimally small area of the secondary lens (projection lens 18 or reflector 36). Without the cylindrical lens (cylindrical lens 30 or cylindrical reflector 33), each secondary lens zone would be substantially of the same size, and delineate projections of the primary lenses 12 having the same orientation. The projections of the various secondary lens zones would thus all have the same shape and size, and would be merely be displaced against one another in order to generate the desired light distribution 19. By the cylindrical lens these projections are now all vertically separated from one another in the same way (cf. FIG. 7B). The projections of an infinitesimal lens surface are all sharply focused due to the infinitesimal aperture. FIG. 7A shows a primary light distribution 15 on the indicated light exit surface 16 of a primary lens 12, in particular a collecting lens. The secondary lens (projection lens 18 or reflector 36) generates the secondary light distributions 19 from these illuminated surfaces 15, which supplement one another, and form the desired resulting light distribution 21 of the light module 7. By the cylindrical lens, the illuminated surfaces 15 on the light exit surfaces 16 of the primary lenses 12 can be spaced apart from one another in the vertical direction (anamorphic enlargement), such that an enlarged projection 38 is obtained (cf. FIG. 7B). The width of the illuminated surfaces 15 remains substantially unchanged thereby, i.e. the width of the enlarged projection 38 is substantially the same size as the width of the illuminated surfaces 15 on the light exit surfaces 16 of the primary lenses 12.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A light module of a headlamp for a motor vehicle, comprising:

a plurality of semiconductor light sources that can be individually activated, and are disposed in a matrix, adjacent to and/or above one another, for emitting a light;

a plurality of primary lenses disposed in a matrix, adjacent to and/or above one another, allocated to the semiconductor light sources, for bundling at least a portion of the light emitted by the plurality of semiconductor light sources, and for generating a plurality of primary light distribution on respective light exit surfaces of the plurality of primary lenses; and a shared secondary lens for projecting the plurality of primary light distributions as a plurality of secondary light distributions on a roadway in front of the motor vehicle, such that the plurality of secondary light distributions illuminate a high-beam region, wherein the plurality of secondary light distributions generated by the secondary lens exhibit vertical light/dark borders, and wherein a cylindrical lens is disposed in a beam path of the light module between the plurality of primary lenses and the secondary lens, wherein the cylindrical lens exhibits substantially no refraction in a horizontal cross-section, and wherein the cylindrical lens exhibits light collecting characteristics in a vertical cross-section.

2. The light module as set forth in claim 1, wherein the cylindrical lens has a cylinder axis oriented such that it is substantially horizontal and transverse to an optical axis of the secondary lens.

3. The light module as set forth in claim 1, wherein the cylindrical lens has a cylinder axis oriented such that it is transverse to an angle bisector of an angle spanning an optical axis of the plurality of primary lens and an optical axis of the secondary lens.

4. The light module as set forth in claim 1, wherein the cylindrical lens is a cylindrical reflector.

5. The light module as set forth in claim 1, wherein the secondary lens is a projection lens.

6. The light module as set forth in claim 1, wherein the plurality of primary lenses are collecting lenses.

7. The light module as set forth in claim 6, wherein the plurality of semiconductor light sources are disposed between the collecting lenses and an object-side focal point of the collecting lenses.

8. The light module as set forth in claim 1 wherein the cylindrical lens is a cylindrical reflector disposed in the beam path such that it bends the beam path.

9. The light module as set forth in claim 8, wherein the cylindrical reflector bends an optical axis of the light module in a horizontal plane or a vertical plane.

10. The light module as set forth in claim 1, wherein the cylindrical lens causes an anamorphic enlargement of the plurality of primary light distributions on the light exit surfaces of the plurality of primary lenses by a multiple thereof.

11. The light module as set forth in claim 10, wherein the secondary lens is a projection lens, wherein the projection lens includes a region at a top and a bottom that is flattened off, substantially horizontally.

12. The light module as set forth in claim 1 wherein the secondary lens is configured such that the plurality of secondary light distributions projected therefrom onto the roadway in front of the motor vehicle border one another directly, without overlapping of adjacent ones of the plurality of secondary light distributions.

13. The light module as set forth in claim 1, wherein the secondary lens is configured such that the plurality of secondary light distributions projected therefrom onto the roadway in front of the motor vehicle are disposed adjacent to one another, wherein at least a respective lateral region of adjacent ones of the plurality of secondary light distributions overlap one another.

14. The light module as set forth in claim 1, wherein the light module is configured for targeted deactivation of individual ones of the plurality of semiconductor light sources upon detection of an other road user in a corresponding one of the plurality of secondary light distributions, wherein the deactivation of the individual ones of the plurality of semiconductor light sources occurs as a function of a signal from detector for detecting the other road user in front of the motor vehicle.

15. A headlamp for a motor vehicle, comprising a housing (2) having a light exit aperture closed by a transparent cover plate, and at least one light module as set forth in claim 1.

16. The light module as set forth in claim 1, wherein the secondary lens is a reflector.

* * * * *